US007396456B2

(12) United States Patent
Tsai

(10) Patent No.: US 7,396,456 B2
(45) Date of Patent: Jul. 8, 2008

(54) CRUISING AERATION APPARATUS AND METHOD

(75) Inventor: Rong-Feng Tsai, Yunlin Hsien (TW)

(73) Assignee: National Huwei University of Science and Technology, Huwei, Yunlin (TW)

( * ) Notice: Subject to any disclaimer, the term of this patent is extended or adjusted under 35 U.S.C. 154(b) by 278 days.

(21) Appl. No.: 11/212,730

(22) Filed: Aug. 29, 2005

(65) Prior Publication Data

US 2006/0076283 A1 Apr. 13, 2006

(30) Foreign Application Priority Data

Oct. 11, 2004 (TW) ..... 93130783 A

(51) Int. Cl.
*C02F 7/00* (2006.01)
*C02F 3/02* (2006.01)
*E04H 4/14* (2006.01)

(52) U.S. Cl. ..... 210/167.1; 210/167.11; 210/170.05; 210/170.06; 210/242.2

(58) Field of Classification Search ..... 210/167.1, 210/167.11, 167.26, 170.05, 170.06, 242.2; 261/78.1, 78.2, 34.1; 239/20
See application file for complete search history.

(56) References Cited

U.S. PATENT DOCUMENTS 2,825,541 A * 3/1958 Moll et al. ..... 261/29
2,934,409 A * 4/1960 Melvin ..... 422/265
3,759,495 A * 9/1973 Boler et al. ..... 261/92
3,840,457 A * 10/1974 Wilson ..... 210/629
4,268,398 A * 5/1981 Shuck et al. ..... 111/101
4,482,510 A * 11/1984 Khudenko ..... 261/91
4,485,013 A * 11/1984 Cockman ..... 210/242.2
4,587,064 A * 5/1986 Blum ..... 261/37
4,680,148 A * 7/1987 Arbisi et al. ..... 261/120
5,510,022 A * 4/1996 Mullis ..... 210/170.06
5,730,861 A * 3/1998 Sterghos et al. ..... 210/86
5,971,372 A * 10/1999 Ash ..... 261/120
6,050,550 A * 4/2000 Burgess ..... 261/29

* cited by examiner

*Primary Examiner*—Fred Prince
(74) *Attorney, Agent, or Firm*—Muncy, Geissler, Olds & Lowe, PLLC

(57) ABSTRACT

A cruising aeration apparatus and a method are described. The cruising aeration apparatus comprises an aeration device for circulating the water in an aquatic pool, at least one conducting element connected to the aeration device for conducting the aeration device along a traveling route, and a controller. The at least one conducting element can be a rope or a float loop used as a separation line of a swimming pool. The pool water is drawn and pressurized by the aeration device and then ejected from nozzles of the aeration device. The nozzles on the front side and the rear side of the traveling route of the aeration device produce different counterforce. The aeration device is driven along the traveling route by the difference between the counterforce of the front side and the rear side of the traveling route. At least one switch is installed to control the opening and the closing of the nozzles, and is located on the side of the aeration device providing larger counterforce. The on/off of the at least one switch is controlled by the controller, so that the counterforce magnitude of the front side and the rear side of the aeration device can be interchanged to drive the aeration device to move reciprocally.

10 Claims, 6 Drawing Sheets

| | | |
|---|---|---|
| (a) Water Pump ON | Electromagnetic Valve ON | Preceeding Forward |
| (b) Water Pump OFF | Electromagnetic Valve OFF | Standstill |
| (c) Water Pump ON | Electromagnetic Valve OFF | Moving Backward |
| (d) Water Pump OFF | Electromagnetic Valve OFF | Standstill |

Fig. 6

CRUISING AERATION APPARATUS AND METHOD

RELATED APPLICATIONS

The present application is based on, and claims priority from, Taiwan Application Serial Number 93130783, filed Oct. 11, 2004, the disclosures of which are hereby incorporated by reference herein in their entirety.

FIELD OF THE INVENTION

The present invention relates to an apparatus and a method for circulating water in an aquatic pool, and more particularly, to a cruising aeration apparatus and a cruising aeration method, in which the cruising aeration apparatus (CAA) can reciprocate backwards and forwards continually by adjusting the direction or magnitude of the counterforce resulting from the ejection of water jets of the two sides of the apparatus (CAA).

BACKGROUND OF THE INVENTION

Aquatic pools, fishponds or fishing farms usually requires aeration devices to maintain the concentration of dissolved oxygen (DO), which is absolutely necessary and important to the breathing of aquatics, underwater organisms and microorganisms, the stabilization of water quality, and the ecological balance of aquatic pools. Microorganisms have to absorb dissolved oxygen from the water to decompose the redundant organic material and to perform nitrification, which transforms ammonia of higher toxicities into nitrous or nitric acid ($NO_2^-$, $NO_3^-$) of lower toxicities. A paddlewheel, a typical conventional aeration device, splashes the water into the air by its vane wheels driven by a motor, and it increases the exposed time and surface area between the water droplets and air, so as to achieve the purposes of aeration and increasing the dissolved oxygen.

An aerobic treatment pool of a waste water treatment factory of the general environmental protection and the chemical industries also use microorganisms to decompose the organic materials in the water. In these applications, a blowing machine, an air pipe and air vents of ecoflex discs are typically used to transport air to the bottom of the pool, at which the air is transformed as a plurality of small air bubbles and liberated at the pool bottom. The mixing of small air bubbles and water increases the concentration of dissolved oxygen of the pool water, and, therefore, promotes the decomposition rate of the organic materials by microorganisms.

Although the traditional paddlewheel has been widely used in aquatic pools for a long history, its aeration effect on increasing the concentration of dissolved oxygen is quite small, especially for the region close to the bottom of the pool or those not very close to the paddlewheel. Therefore, aquatic pools of wider areas usually require a number of conventional paddlewheel, which are installed in different locations to increase the concentration of dissolved oxygen (DO) in the pool. However, the power consumption is large due to its poor aeration efficiency, and the cost is expensive since a number of paddle wheels are required.

SUMMARY OF THE INVENTION

The objective of the present invention is, therefore, to provide a cruising aeration apparatus and method. For the aeration method, an aeration device of CAA can reciprocally move back and forth along a route, which may be across two sides of the pool, so that the aeration device (CAA) can homogeneously pump the aquatic water into the air along the route to aerate a large amount of water and increase the concentration of dissolved oxygen.

One other objective of the present invention is to provide a cruising aeration apparatus (CAA) and a cruising aeration method of low power consumption and low instrumentation cost since the aeration area of a present cruising aeration apparatus (CAA) is ten times larger that a traditional paddle wheel. As a result, a set of CAA is enough o for an aquatic pool of large areas. For aquatic pools of very large areas, a number of CAA may be installed equidistantly from one another, and they reciprocate in the same direction.

A further objective of the present invention is to provide a cruising aeration apparatus and a cruising aeration method, which can greatly increase the concentration of dissolved oxygen close to the bottom area of the pool which is of good use to the benthos living at the bottom of the pool and, particularly, to those of poor swimming abilities like shell fishes, prawns abalones; ear shell and so on.

According to the aforementioned objectives, the present invention provides a cruising aeration apparatus, comprising a mobile aeration device, at least one conducting element to guide the moveable aeration device, and a controller. The conducting element may be a rope or a float loop similar to the separation lines used in a swimming pool. The moveable aeration device comprises a filter, a number of nozzles installed in the front, back, left and right sides, a pontoon device and a pumping device, which may be a water pump or an immersible pump. The pontoon device is connected to outer side of the filter.

The nozzles at the front and rear sides along the traveling route of the device, are used to inject water to generate counterforce, so as to push the apparatus back and forth. The magnitude of counterforce may be controlled by changing the number or the size of nozzles at the two sides.

For example, the nozzles at the front and back sides generate larger and smaller counterforce, respectively.

The open/close of the nozzles on the side of the moveable aeration device including more nozzles may be controlled by a switch, such as a motorized valve or motorized valve, in which the switch is controlled by the controller. The controller may be a programmable logic circuit (PLC) or a combination of a single chip and a relay. Alternatively, the numbers of the nozzles on the two sides of the moveable aeration device may be the same.

According to the aforementioned objectives, the present invention further provides a cruising aeration method, comprising: providing a moveable aeration device for circulating aquatic water; providing at least one conducting element to connect with the moveable aeration device for conducting the moveable aeration device; and providing a controller to control nozzles of the moveable aeration device. With the difference of the counterforce in the front side and the rear side of the traveling route in the moveable aeration device, the motive force that drives the moveable aeration device to move toward the side with smaller counterforce is produced. When the motorized valve is turned off by the controller, the nozzles on the side with larger counterforce are closed, so that the counterforce magnitude of the front side and the rear side of the traveling route interchanges to make the aeration device move reversely. In addition, the controller can turn the pumping device of the aeration device on or off to make the aeration device move or stop. The aeration device can also balance itself.

According to the above description, the force source for driving the aeration device of the present invention is the pumping device. The water is drawn and pressurized by the pumping device, and then is ejected from the nozzles, which thereby produces a counterforce to provide force to drive the aeration device. Along with the proceeding of the aeration device, the conducting elements connected to the left side and the right side of the aeration device are extended or contracted, so as to make the aeration device move forward or backward along the traveling route. In another embodiment of the present invention, both the front side and the rear side of the traveling route in the aeration device are set with a switch, respectively, such as an motorized valve, to control the on/off of the nozzles. In the embodiment, the counterforce magnitude of the front side and the rear side of the traveling route does not need to be different. The counterforce magnitude of the front side and the rear side of the traveling route can interchange by turning on or off the motorized valves of the front side and the rear side, so as to achieve the effect of reciprocally moving. The controller is used to control the on/off of the motorized valves and the pumping device, and when the pumping device is turned off, the aeration device stops moving.

The controller of the present invention can control the state of the motorized valves by a timely controlled design, to make the aeration device automatically reverse at a predetermined time.

The present invention is suitable for use in an aquatic pool for cultivating benthos and poor-mobility shellfish, such as shrimp, spiral shells, clam, small abalone, lobster or abalone. Further, the present invention is also suitable for the aeration treatment of highly polluted water.

BRIEF DESCRIPTION OF THE DRAWINGS

FIG. 6 is the flow chart of a processing method for performing one embodiment of the present invention.

DETAILED DESCRIPTION OF THE PREFERRED EMBODIMENT

Figure 1:
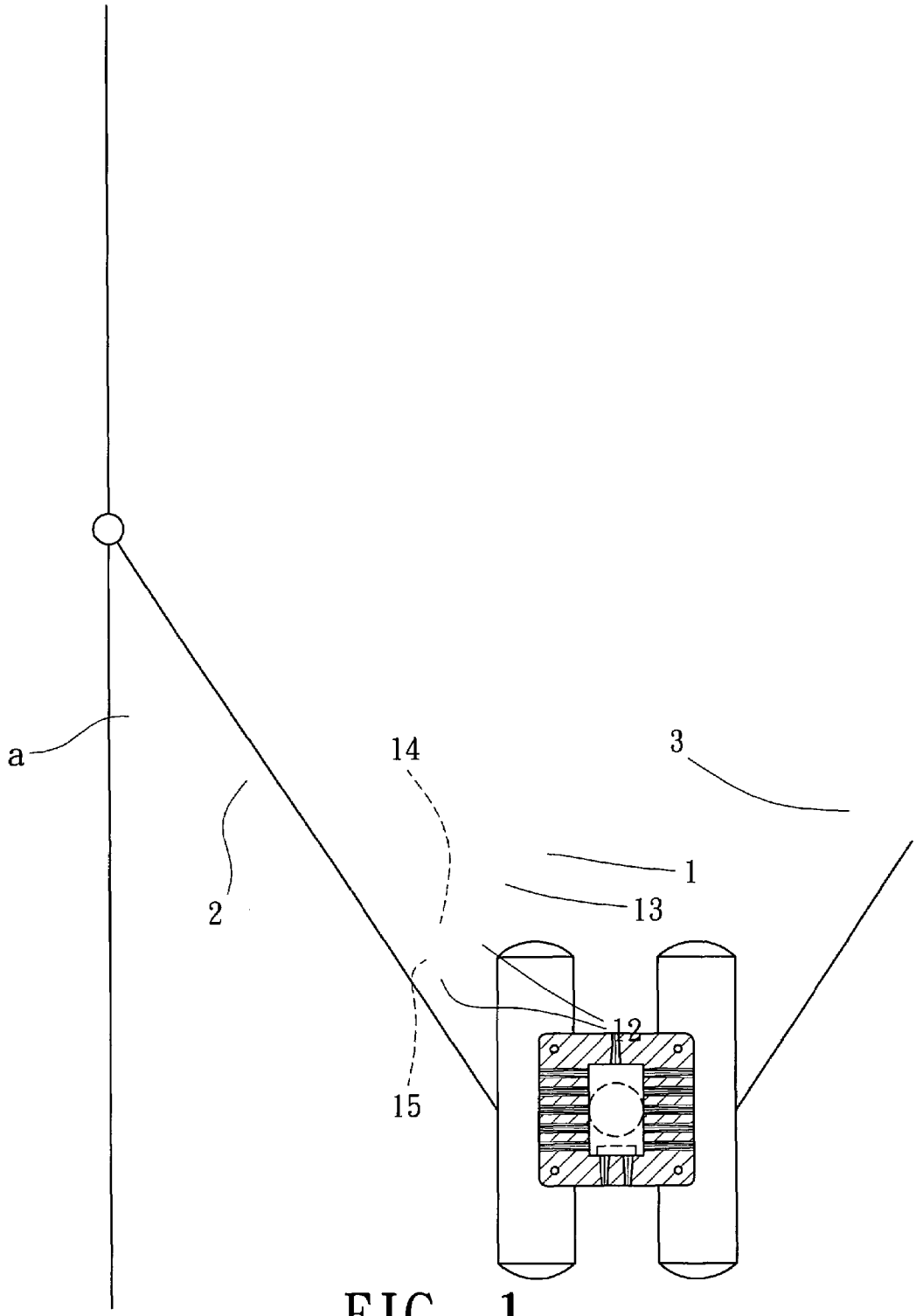
FIG. 1 is the top view of a cruising aeration apparatus in accordance with a preferred embodiment of the present invention.
Figure 2:
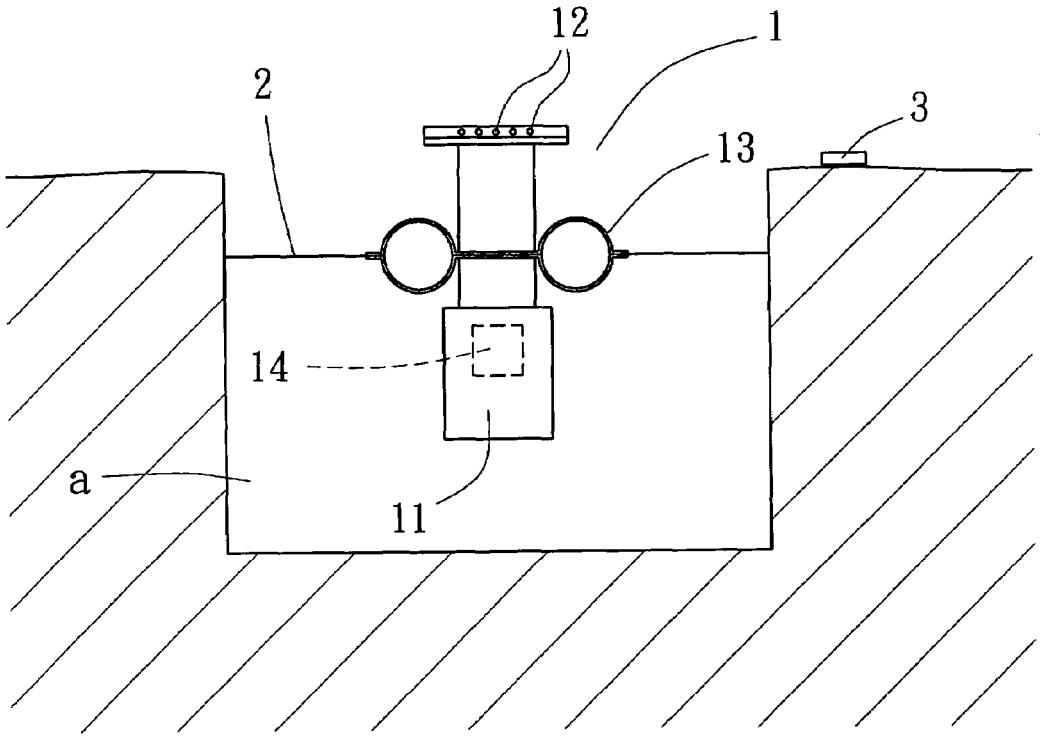
FIG. 2 is the front view of a cruising aeration apparatus in accordance with a preferred embodiment of the present invention.
Figure 3:
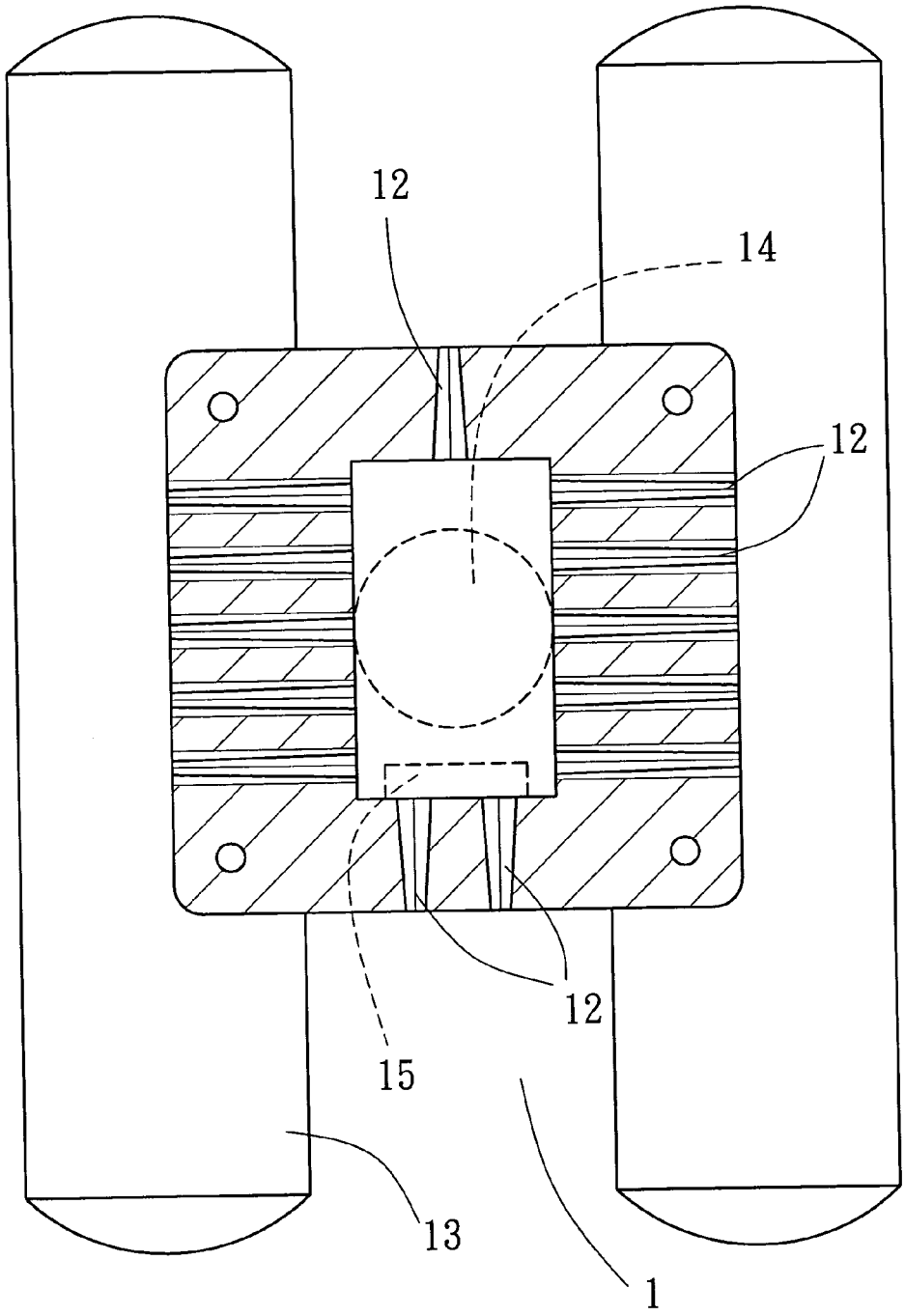
FIG. 3 is the enlarged schematic diagram of the main portion of a cruising aeration apparatus in accordance with a preferred embodiment of the present invention.

The present invention discloses a cruising aeration apparatus and a cruising aeration method. Referring to FIGS. 1 to 3, the cruising aeration apparatus of the present invention comprises an aeration device 1, which, at least, includes a filter 11, a plurality of nozzles 12, a pair of pontoon device 13 and a water pump 14. The filter 11 is located under the pontoon device 13. The water is first filtered by the filter 11, then is pressurized by water pump 14 and is finally ejected through the nozzles 12. The nozzles 12 were designed to atomize water into small droplets and to generate counterforce to push the cruising aeration apparatus. Referring to FIG. 3, the numbers of the nozzles on the aeration device 1 at the front side and the rear side of the traveling route are different. It should be noted that larger counterforce may be achieved by increasing the number or the diameter of nozzles 12 or by injection water at directions close to axis of the traveling route. A motorized or motorized valve 15 was used to turn on/off of the nozzles at the side of larger counterforce.

The numbers of the nozzles 12 on the left side and the right side of the traveling route are the same. The nozzles 12 are preferably installed with an upward inclination angles of between 15 and 40 degrees to achieve longer aeration time and longer ejection distance, and, therefore, higher aeration efficiency is therefore, achieved. Referring to FIG. 2, the aeration device 1 is floated on the water surface by the pontoon device 13, and the device 1 can balance itself due to a low positions of its center of gravity. The water is pressurized by thee water pump, and the ejection of water through the nozzles 12 provide counterforce to drive the aeration device 1.

The aeration apparatus includes two ropes 2 to limit the movable range of the aeration device 1. Referring to FIGS. 1 and 2, the ropes 2 are respectively connected to the left side and the right side of the traveling route of the aeration device 1, and the ropes 2 are extended or contracted following the movement of the aeration device 1.

The aeration apparatus further includes a controller 3, which may be a programmable logic circuit (PLC) or a combination of a single chip and a relay. The controller 3 is used to control the motorized valve 15 and the water pump 14 of the aeration device 1 on or off.

Figure 4:
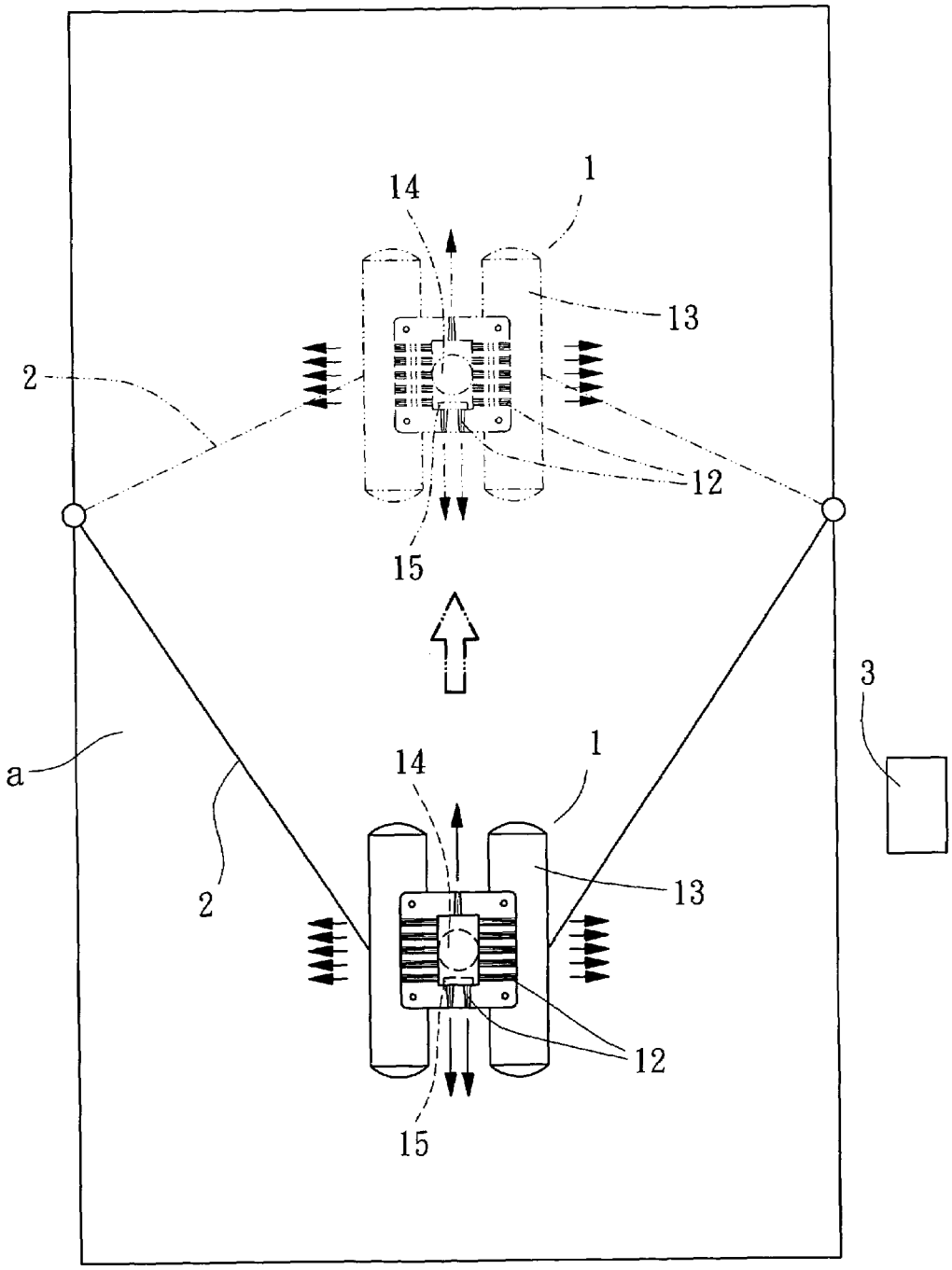
FIG. 4 is the process sequence used to implement a cruising aeration apparatus in accordance with a preferred embodiment of the present invention.
Figure 5:
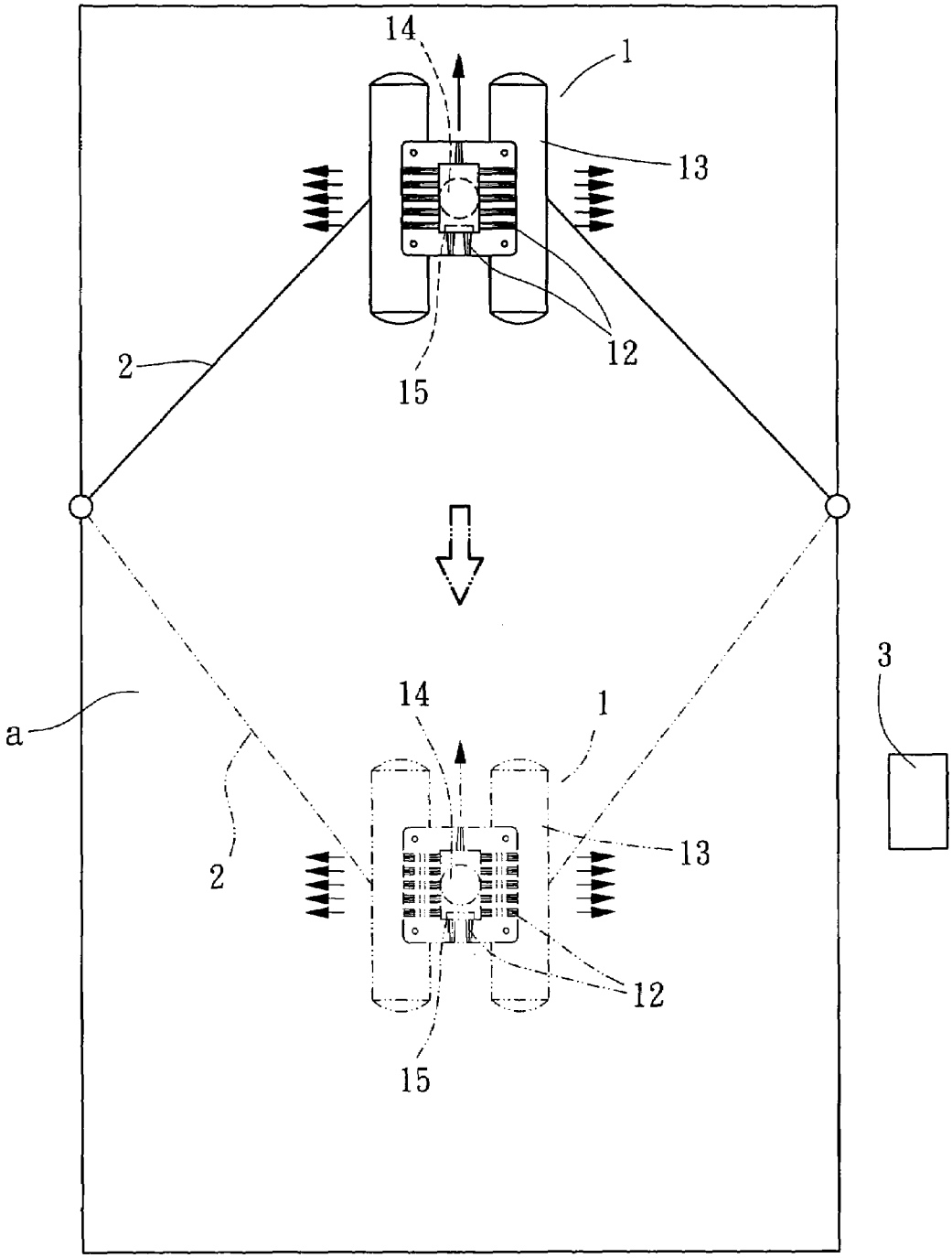
FIG. 5 is the process sequence used to implement a cruising aeration apparatus in accordance with a preferred embodiment of the present invention.

Referring to FIGS. 4 and 5, a feature of the present invention is to use the difference of counterforce between the front side and the rear side of the traveling route of the aeration device 1 to drive the aeration device 1 toward the side with smaller counterforce. The reciprocal movement of the aeration device 1 is achieved by using the controller 3 to turn off the electromagnetic valve 15, so that the nozzles on the side, which includes the nozzles of larger counterforce, of the front side and the rear side of the traveling route are closed. Therefore, only the nozzles on the side, which includes the nozzles with smaller counterforce, of the front side and the rear side of the traveling route can eject water and provide counterforce, to drive the aeration device 1 backward. As the controller 3 is used to switch the state of the motorized valve 15 again, another reciprocal movement begins. To sum up, the nozzles on the front side and the rear side of the traveling route control the direction of the aeration device 1, and the nozzles on the left and right sides of the traveling route can aerate water and increase the concentration of dissolved oxygen in the water. The flow path of the nozzles may be inclined upward, and may be designed with gradually narrowing channels for pressurizing.

The controller 3 of the present invention switches the motorized or motorized valve 15 according to a sequential-controlled method, and the state of the motorized or motorized valve may be changed at a predetermined time sequence by the controller 3, so as to turn the nozzles 12 on or off. The nozzles on the left side and the right side of the traveling route are always open, and the net counterforce of the left and right sides are negligible since the two counterforce eliminate each other. With the ropes 2, the aeration device 1 may freely move in the predetermined region. The setting procedure of the aeration apparatus is shown in FIG. 6. In step (a), the water pump and the electromagnetic valve are turned on, and the aeration apparatus proceeds forward. In step (b), the water pump and the electromagnetic valve are turned off, and the aeration apparatus stops. In step (c), the water pump is turned on, the motorized or motorized valve is turned off, and the aeration apparatus moves backward. In step (d), the water pump and the electromagnetic valve are turned off, and the aeration apparatus stops. After the durations of steps (a) to (d) are respectively set, steps (a) to (d) are performed sequentially and a new cycle repeated, so as to make the aeration device 1 move reciprocally and continuously aerate pool water along the traveling route and increase the concentration of dissolved oxygen on the way.

The water pump 14 of the aeration device 1 is a pumping device used as the force source to move the aeration device 1. The pumping device of the present invention is not limited to water pumps 14. With the power of the water pump 14 and the thrust due to the net counterforce, the aeration device 1 may be driven to move reciprocally and continuously, so that the effects of aerating and dissolving oxygen in the water may be spread to over the entire aquatic pool to achieve the objective of high performance at low cost. Compared with the prior art, which requires several aeration devices installed at fixed locations, the present invention is greatly improved, so that the total cost of equipment is reduced since fewer equipments are needed due to its high cost effective performance. The present invention may be applied in various manners. For example, only an aeration apparatus of the present invention is used for a smaller aquatic pool, while several aeration apparatuses, that reciprocally and continuously move parallel to one another, are set equidistantly for a larger aquatic pool, rather than several fixed aeration apparatuses being installed everywhere in a specified range. Accordingly, the present invention is suitable for an indoor aquatic pool for cultivating benthos and poor-mobility shellfish, such as shrimp, spiral shells, clam, small abalone, lobster or abalone. The present invention is further suitable for the aeration treatment of waste water of high values of BOD.

According to the aforementioned description, one advantage of the present invention is that with the application of the cruising aeration apparatus and method, only one aeration device 1 is needed for a smaller aquatic pool. For a larger aquatic pool, the least number of aeration devices is needed to achieve the effect of actively aerating the whole pool, so that the cost and the power consumption can be greatly reduced.

In addition, a motorized valve may be installed on both of the front and rear sides of the aeration device of the traveling route. The two motorized valves may be switched on/off alternatively versus each other. For example, one of the motorized valve is switched on, and the other is off, and, therefore the aeration device is pushed toward to the other side relative to direction of water jet.

In such embodiment, the magnitude of the counterforce of the two sides may be the same or different, and the reciprocal movement of the aeration device may be achieved by interchanging the direction of counterforce on the two sides. The rope may be replaced with a float loop used as a separation line of a swimming pool.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A cruising aeration apparatus, including:

a moveable aeration device moving along a traveling route, wherein the traveling route is across two sides of an aquatic pool, and the moveable aeration device comprises:

a water pump;

a pontoon device for maintaining a balance of the moveable aeration device floating on the water;

a filter for filtering water in the aquatic pool;

a plurality of nozzles, wherein a counterforce produced by a part of the nozzles located on a front side of the traveling route is different from a counterforce produced by another part of the nozzles located on a rear side of the traveling route; and at least one switch installed on either the front side or the rear side of the traveling route, wherein a side with the at least one switch installed thereon has a larger counterforce, and the nozzles on the front side or the rear side of the traveling route are opened or closed by turning on or off the at least one switch;

at least one conducting element connected to the moveable aeration device to conduct the moveable aeration device; and a controller used to turn the at least one switch and the water pump of the moveable aeration device on or off.

2. The cruising aeration apparatus according to claim 1, wherein the at least one conducting element is connected to a left side and a right side of the traveling route of the moveable aeration device, and the at least one conducting element is extended or contracted according to movement of the moveable aeration device.

3. The cruising aeration apparatus according to claim 1, wherein the filter is located beneath the pontoon device.

4. The cruising aeration apparatus according to claim 1, wherein the at least one switch is an electromagnetic valve.

5. The cruising aeration apparatus according to claim 4, wherein the controller is connected with the electromagnetic valve by a wire.

6. The cruising aeration apparatus according to claim 4, wherein the controller operates the electromagnetic valve, and the controller and the electromagnetic valve communicate wirelessly.

7. The cruising aeration apparatus according to claim 1, wherein the at least one conducting element is a rope.

8. The cruising aeration apparatus according to claim 1, wherein the at least one conducting element is a float loop used as a separation line of a swimming pool.

9. The cruising aeration apparatus according to claim 1, wherein the controller is selected from the group consisting of a programmable logic circuit and a combination of a single chip and a relay.

10. A cruising aeration apparatus, including:

a moveable aeration device moving along a traveling route, wherein the traveling route is across two sides of an aquatic pool, and the moveable aeration device comprises:

a water pump;

a pontoon device for maintaining a balance of the moveable aeration device on the water;

a filter for filtering water in the aquatic pool;

a plurality of nozzles; and two switches respectively installed on the front side and the rear side of the traveling route, wherein the nozzles on the front side and the rear side of the traveling route are opened or closed by turning on or off the switches; and at least one conducting element limiting the moveable aeration device to movement within a specified range; and a controller used to turn the switches and the water pump of the moveable aeration device on or off.

* * * * *